United States Patent [19]

Lyman

[11] Patent Number: 5,028,317

[45] Date of Patent: Jul. 2, 1991

[54] CONTROL OF JIG SEPARATORS

[75] Inventor: Geoffrey J. Lyman, Yeronga, Australia

[73] Assignee: University of Queensland, St. Lucia, Australia

[21] Appl. No.: 294,511

[22] PCT Filed: Jun. 29, 1987

[86] PCT No.: PCT/AU87/00185

§ 371 Date: Dec. 22, 1988

§ 102(e) Date: Dec. 22, 1988

[87] PCT Pub. No.: WO88/00095

PCT Pub. Date: Jan. 14, 1988

[30] Foreign Application Priority Data

Jun. 27, 1986 [AU] Australia ..... PH6612

[51] Int. Cl.[5] ..... B03B 5/24

[52] U.S. Cl. ..... 209/457; 209/489; 209/491; 209/496

[58] Field of Search ..... 209/455, 457, 456, 489, 209/490, 491, 496, 500

[56] References Cited

U.S. PATENT DOCUMENTS

| | | | |
|---|---|---|---|
| 3,082,873 | 3/1963 | Bartelt | 209/491 |
| 4,176,749 | 12/1979 | Wallace et al. | 209/457 |
| 4,265,744 | 5/1981 | Weiffen | 209/457 |
| 4,342,654 | 8/1982 | Lambert | 209/457 |

FOREIGN PATENT DOCUMENTS

| | | | |
|---|---|---|---|
| 1115651 | 10/1961 | Fed. Rep. of Germany . | |
| 1217292 | 5/1966 | Fed. Rep. of Germany . | |
| 1245281 | 7/1967 | Fed. Rep. of Germany . | |
| 2822979 | 11/1979 | Fed. Rep. of Germany . | |
| 3106114 | 9/1981 | Fed. Rep. of Germany . | |
| 928665 | 12/1947 | France . | |
| 2075867 | 11/1981 | United Kingdom | 209/456 |
| 2131182 | 6/1984 | United Kingdom . | |

OTHER PUBLICATIONS

Derwent Abstract Accession No. 84-242854/39, Class P41, SU, A, 1072-906 (Kazapoly), Feb. 15, 1984.

Bartelt, Dietrich, "Regulating Jig Discharge by Means of Radio-Isotopes", 4th Intl. Coal Preparation Congress, 1962, Papger B-2, pp. 89-97, (See pp. 94, 95--FIG. 7).

Wills, B. A., Mineral Processing Technology, "An Introduction to the Practical Aspects of Ore Treatment and Mineral Recovery", pp. 224-235, Pergamon Press, 1981.

Gaudin, A. M., Principles of Mineral Dressing, Chapter XII, pp. 250-259, McGraw-Hill Book Company, Inc., 1939.

Dept. of Chemical Engineering, Oregon State University, Chemical Reaction Engineering, Ch. 9, pp. 254-259, xix, John Wiley & Sons, 2nd Edition, 1972.

*Primary Examiner*—Donald T. Hajec

*Attorney, Agent, or Firm*—Foley & Lardner

[57] ABSTRACT

The density of the material in the jig bed is measured in consecutive short segments over the jig cycle, the time period of each segment being not greater than one-tenth the cycle time of the jig, to determine the density signature or profile of the jig. By controlling the operating parameters (e.g. inlet and outlet valve opening and closing, underbed flow rate, discharge gate position and jig working air pressure) of the jig, the density signature or profile is maintained within a control envelope for efficient stratification of the mineral.

9 Claims, 4 Drawing Sheets

CONTROL OF JIG SEPARATORS

BACKGROUND OF THE INVENTION (1) Field of the Invention

This invention relates to the control of jig separators used for the beneficiation of minerals. In particular, the invention is directed to an apparatus for measuring the properties of the jig bed. The information derived from the measurements can be used to provide a continuous control signal to improve the operating efficiency of the jig separators by better regulation of the jig operating parameters.

Throughout the specification the term "minerals" should be employed to include such material as coal, tin ores, gold ores, iron ores, manganese ores and such other valuable materials as can be separated from less valuable materials by gravity concentration. The term "jig" is to be interpreted to means any device using a pulsating fluid to produce stratification according to particle specific gravity in a bed of broken mineral. In usual circumstances the jig treats a continuous flow of mineral and is provided with means for continuous or intermittent discharge of the lower specific gravity and higher specific gravity fractions of the mineral mixture.

(2) Prior Art

The accepted principles of jig operation are described by Wills (B. A. Wills, Mineral Processing Technology, 2nd Edition, Pergamon Press, 1981). Gaudin (A. M. Gaudin, Principles of Mineral Dressing, McGraw Hill, 1939) also discusses the physics of jig operation and means of control of discharge of dense material from jigs.

There are two requirements for efficient jig operation, namely (i) control of heavy product discharge from the jig, and (ii) control of the stratification of the mineral bed in the jig. The term stratification generally refers to the variation in particle density as a function of vertical position in the jig bed in the compacted or closed state. Assuming that the discharge of the dense material is correctly performed, the separation effected by the jig will be more efficient if the stratification is such that the dense mineral and less dense mineral components are present in distinct layers, facilitating discharge of either layer from the jig. If more dense, material is discharged at too high a rate from the bed in a jig compartment, the stratification profile will be altered and it will become impossible to maintain either the desired separation or the efficiency of separation. The desired separation in a jig compartment can be quantitatively described by the jig separation specific gravity $SG_{50}$. $SG_{50}$ is the density of those mineral particles which are recovered at equal mass flow rates in both the dense and less dense product streams from the compartment.

Various means of regulation of $SG_{50}$ are known. They all involve making an indirect measurement of jig bed characteristics combined primarily with feedback control of the discharge of dense mineral from the jig, or less commonly, with manipulation of the jig operating parameters.

Most commonly, a so-called "float" is suspended in the bed by a vertical rod, or similar arrangement and the position of the float is sensed by electro-mechanical means. The float is usually a suitably shaped (e.g. "streamlined") body which, by use of weights can be caused to have a chosen or adjustable effective specific gravity. The float is usually intended to indicate the position of the top of the layer of most dense mineral in the bed. By maintaining the position of the top of the latter layer constant through regulation of discharge of the most dense mineral layer, it is intended that the $SG_{50}$ for the jig shall remain constant.

In addition to the use of floats, it is also known to use pressure sensors to indicate the hydrostatic pressure at one or more points in the jig bed. The pressure signals can be interpreted to indicate the average specific gravity of the bed as a whole or the depth of the bed or the average specific gravity of the bed in a chosen zone of the bed.

In the control of bed depth or specific gravity, it must be recognised that the jig operates in a cyclical way due to the regular pulsation of the fluid in the jig. The periodic motion of the fluid results in corresponding periodic variations in the jig bed properties. Consequently, the measures of float position or pressures must be made at a prescribed point in time within the jig cycle or period, or the signal from the sensor must be averaged over the jig cycle in a meaningful way.

It is also known to use signals from pressure sensors located in the jig bed, water level indicators or mechanical paddle sensors to assist in jig regulation (e.g. see British Pat. No. 1,597,231 (Norton-Harty Colliers Engineering Limited) and German Pat. No. 1,217,292 (Stamicarbon NV)). The signals from the sensors at prescribed times within the jig cycle or as average values are interpreted to indicate the general condition of the jig bed. The signals from mechanical paddles (torque signal) can be interpreted as an indication of the degreee of bed expansion caused by the jig pulsion stroke. Regulation of jig discharge or jig stroke can be employed to maintain signals indicative of general bed properties constant.

The most direct measure of jig bed density known is described by Bartelt (D. Bartelt, "Regulating Jig Discharge by means of Radioisotopes", Fourth International Coal Preparation Congress, 1962, Paper B-2, pp. 89–97). Bartelt employed a gamma ray source (Caesium 137) and a radiation detector (halogen-quenched Geiger counter tube) to determine the average jig bed density at a chosen horizon in the jig bed. This technique of measurement significantly improved regulation of jig bed properties and the jig separation efficiency when the measurement signal was employed to regulate jig bed discharge instead of a float sensor signal.

The first Addition to French Pat. No. 1,382,798 (Beteiligungs-und Patentverwaltungs (GmbH) describes a method for regulation of the jig bed discharge based simply on the mean absorption of the radiation, as a measure of bed density, in a specific horizontal plane in the bed, while German Pat. No. 1,115,651 (Maschinenfabrik Buckau R. Wolf AG) describes a method where the radiation source and detector are moved vertically to maintain a constant absorption rate, the movement being utilized to control the vertical position of the discharge gate to maintain the gate within a prescribed transition zone.

German Pat. No. 1,245,281 (Beteiligungs-und Patentverwaltungs GmbH) describes a method of controlling the discharge where the radiation absorption is only monitored during that portion of the cycle when the jig bed is densely packed. This method does recognise that the bed density in a particular horizontal plane varies with time within a jig cycle but fails to recognise that this density variation with time can be employed to measure the dilation of the bed and that bed dilation behaviour is important in establishing stratification.

German Pat. No. 1,123,631 (Mannesmann AG) describes a method for the continuous monitoring of the bed density to control the operation of the discharge gate on the ampblade of the water column, while German Pat. No. 1,131,611 (also by Mannesmann AG) describes a jig separator where the discharge gate or valve is opened when the absorption rate, and thereby the bed density, varies by a predetermined value from a present value.

German Pat. No. 1,132,872 (Mannesmann AG), which is a Patent of Addition to DE Pat. No. 1,123,631, uses two radiation detectors which are spaced vertically to enable a thicker transition zone to be monitored, the discharge gate being opened to discharge more material when the difference between the absorption measurement by the two detectors decreases, indicating an increase in the thickness of the transition zone.

German Pat. No. 1,140,881 (Mannesman AG) is a further Patent of Addition to DE Pat. No. 1,123,631 and discloses an arrangement of the jig separator for fine or medium granular material where a pair of detectors are provided adjacent the discharge gate, with the source in the middle of the bed.

(The methods described in DE Pat. Nos. 1,123,631, 1,131,611, 1,132,872 and 1,140,881 are also included in U.S. Pat. No. 3,082,873 of Bartelt.)

SUMMARY OF THE PRESENT INVENTION

This invention provides a novel means for measurement of jig bed properties using gamma ray (radioisotope or other) sources and detectors that can be used within a control system to provide control of the separation specific gravity of a jig. Measurement of the transmitted gamma ray intensity is preferably made at one or more horizons in the jig bed and the radiation detector(s) and associated measurement and computational electronics are operated in such a way as to determine the transmitted radiation intensity as a discrete function of time within the operating cycle of the jig.

A scintillation-type gamma ray detector or other suitable detector(s) is employed so that stable determinations of the transmitted gamma ray intensity(ies) can be made at high counting rates and so that gamma ray energy discrimination can be carried out by means of electronic pulse height discrimination when necessary or desired to improve the accuracy of bed density determination. The pulse train(s) from one or more scintillation detectors is directed via pulse shaping and discrimination circuitry to a counter(s). The counter(s) is operated in such a way as to permit determination of the average dead-time-corrected counting rate over consecutive short (less than approximately $1/10^{th}$) segments of the jig cycle. The delineation or definition of the time segments is synchronised with the jig cycle control mechanism or electronics by suitable means.

Commencing with the dead-time-corrected count rate information from consecutive time segments of the jig cycle, further electronic or computational modules may be used to process said information in a variety of ways in order to derive a signal or data output stream that can be employed for automatic control of the jig separation specific gravity through variation of the operating parameters of the jig such as inlet and exhaust valve timing, under bed water flow rate, discharge gate aperture and the like.

One procedure of processing count rate information includes taking the logarithms of the consecutive count rates. The logarithm of the count rate is related linearly to the density of the material in the radiation beam according to fundamental physical principles. When reference dead-time-corrected count rates, such as the count rate when the jig bed is filled with water only, have been recorded, the count rate logarithms can be used to calculte the bed density as a function of time within the jig cycle. The reference count rates are used to take account of radioisotope decay and mechanical wear of metal or plastic parts through which the radiation beam passes. Since the time interval representing a segment of the jig cycle is short (approximately 50 milliseconds) and the count rate at the detector must be limited to the order to 100,000 counts per second at most, the statistical factors that must be taken into account in nucleonic gauging dictate that the count rate will have an uncertainty (measured as the standard deviation of the count rate) of the order of about 1 per cent of count rate. In situations where the path length of the radiation through the bed is long and the bed is collapsed, the count rate at the detector will be much smaller than 100,000 counts per second when a radioisotope course of practial activity is used, and the uncertainty in the count rate corresponding to a single time segment of the jig cycle will be larger than 1 per cent of count rate. In the latter circumstance, the count rate processing procedure should include a "signal averaging" step. Signal averaging is a well-known technique for improving the signal to noise ratio where a cyclical or periodic process signal is of interest. In the present case, signal averaging refers to calculation of an arithmetic average or weighted average of the count rates or logarithms of count rates from corresponding time segments of consecutive cycles of the jig operation. The optimal number of consecutive cycles over which the average is to be calculated depends on the count rates at the detector and the manner in which the signal is being used to control the jig.

A second, simpler, manner of processing the count rate information that may be used either alone or in conjunction with the first manner described above is computation of a mean count rate over each jig cycle or some chosen single time subinterval of the jig cycle. This method corresponds approximately to the procedure implicit within the system described by Bartelt (German Pat. No. 1,123,631) and Bergholz (German Pat. No. 1,245,281). This second manner of count rate information processing does not provide nearly as much information concerning the behavior of the jig bed as the averaging process destroys the information concerning the density variation with time within each cycle when the average is taken over the entire cycle or discards information regarding the variation of density over the complete cycle when the count rate from only a chosen time subinterval is recorded (refer to Bergholz, column 1, line 46 to column 2, line 21).

It appears that the degree of stratification of the jig bed into layers of material of different densities is controlled primarily by the extent to which the bed is expanded or opened up during the jig cycle. This bed expansion or "opening" can be expressed quantitatively in terms of the volume fraction of solids in the bed and the degree of bed expansion varies with vertical position in the bed. Insufficient expansion may lead to less than complete stratification while excessive expansion can lead to vertical mixing and hence suboptimal stratification.

While it is not possible to provide a general description of the degree of bed expansion that will be optimal in all circumstances for the separation of a particular type of ore or for a particular coal feed, it can be said that a recording of the bed density as a continuous or discrete function of time within the jig cycle at a particular horizon in the bed will provide a quantitative measure of the degree of bed expansion as well as a quantitative measure of the maximum bed density corresponding to the point in the cycle when the bed reaches its maximum degree of compaction. For a particular ore or coal feed, there is then one particular pattern of variation with time of bed density within a cycle that corresponds to optimal stratification of the bed and to the most efficient possible separation at a desired separation density. This timewise variation of bed density within a cycle may be referred to as the "jig signature". If the operating parameters of the jig are altered in such a way as to keep the jig signature similar to some optimal signature, then efficient separation can be maintained in the face of modest changes in the density or size distribution of the raw feed and in the face of modest changes in separator throughput. The optimal signature can be discovered through making conventional measures of separator efficiency simultaneously with the measurement of the jig signature.

It is the object of this invention to provide a means of control of jig separation (or separation in any pulsating separator operating substantially similarly to a jig separator) according to a procedure relying on the determination of "jig signatures".

BRIEF DESCRIPTION OF THE DRAWINGS

To enable the invention to be fully understood, a preferred embodiment will now be described with reference to the accompanying drawings, in which.

DETAILED DESCRIPTION OF THE PREFERRED EMBODIMENT

Figure 1:
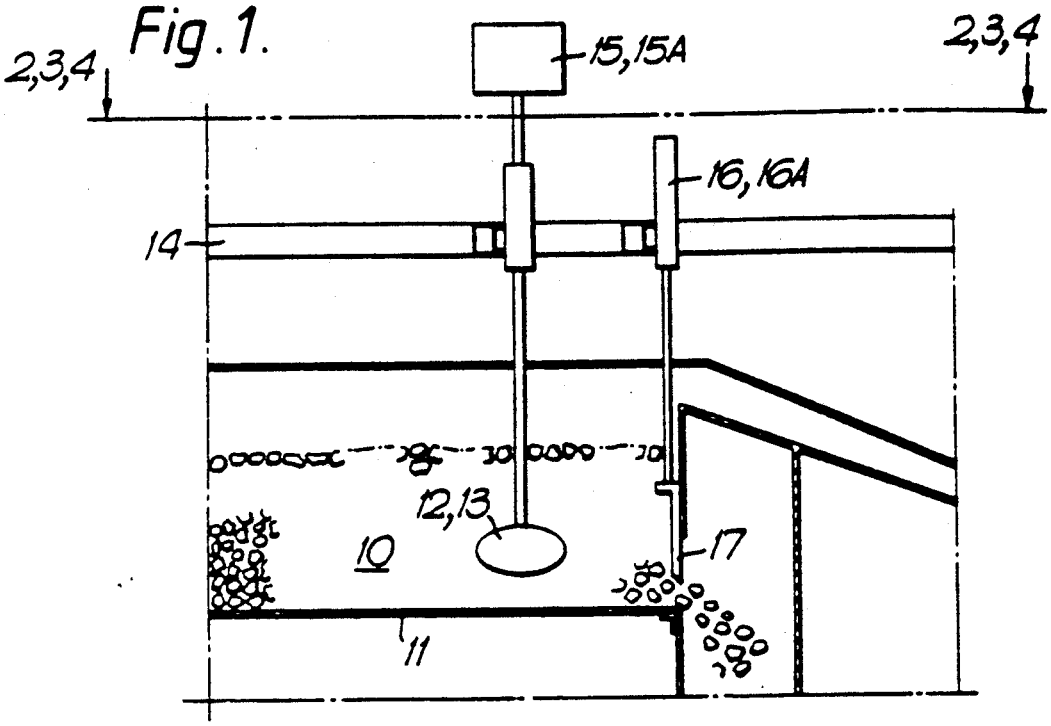
FIG. 1 is a sectional side view of a coal jig separator.
Figure 2:
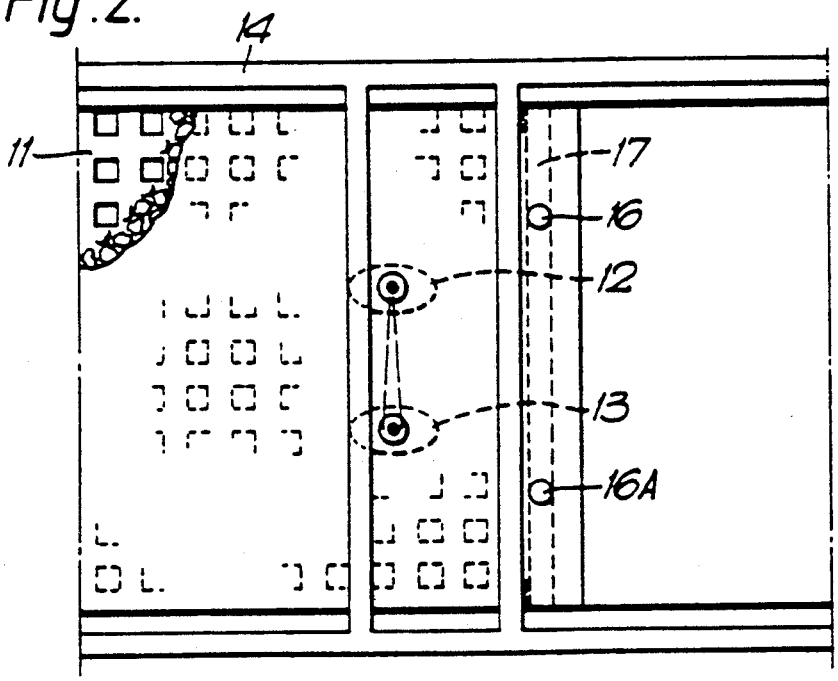
FIGS. 2 to 4 are respective top plan views of the jig separator of FIG. 1 showing alternative source/detector arrangements.
Figure 3:
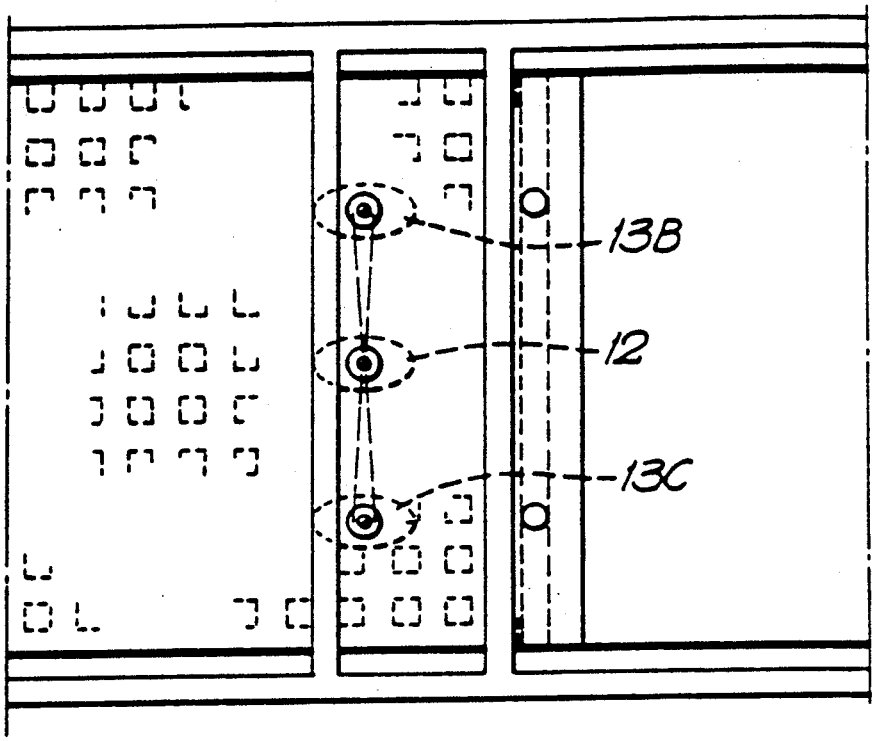
Figure 4:
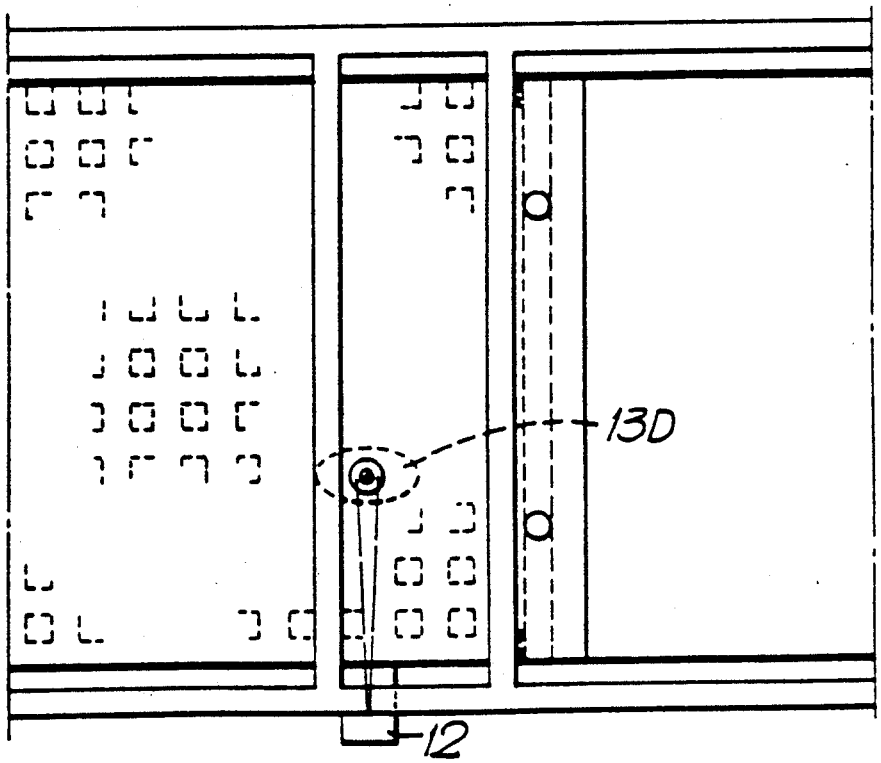

FIG. 1 shows a simplified vertical section of a coal jig bed 10 supported by a screen plate 11 and FIG. 2 shows a related horizontal section. The bed 10 is shown in its collapsed state. A radioisotope source and radiation shield 12 contained within a water-proof steamlined shroud, and a scintillation-type radiation detector 13, also contained within a similar shroud, are immersed in the bed 10. The radioisotope source should emit gamma rays of an energy such that the absorption of the gamma rays is substantially independent of the chemical composition of the material in the bed 10 (Caesium-137 emitting 662 keV gamms or Cobalt-60 emitting gammas in the range of 1.17 to 1.33 keV are suitable sources). The source and detector assemblies are rigidly supported in the jig bed by a suitable frame 14. The separation distance between the source and detector is chosen to suit the type of ore being processed. For usual coal separations, the path length of the radiation through the bed material should be approximately 0.5 meters. The frame 14 may optionally support the mechanism 17 for controlling the discharge of dense material from the lower layers of the bed; the device illustrated here is a simple gate 17 actuated by air or hydraulic cylinders 16, 16A. At the top of the source and detector assemblies there are located sealed housings 15, 15A in which electronic, electrical and electro-mechanical devices for the control of functions of the source shutter mechanism and detector can be enclosed. FIGS. 3 and 4 show horizontal sections similar to FIG. 2 except that they show alternative possible arrangements of sources and detectors. In FIG. 3, the radiation source 12 emits radiation in two directions to be received by detectors 13B and 13C. The use of two detectors in conjunction with one source permits interrogation of a larger volume of the jig bed by the radiation. FIG. 4 shows the radiation source 12 mounted outside the bed on the wall of the jig bed and the radiation detector 13D immersed in the bed. In all circumstances, it is desirable that the manner of fixing the source and detector assemblies be such that vertical adjustment of their position be possible so that the radiation beam can be made to pass through the horizon within the bed that provides best sensitivity with respect to the measured jig signature.

Figure 5:
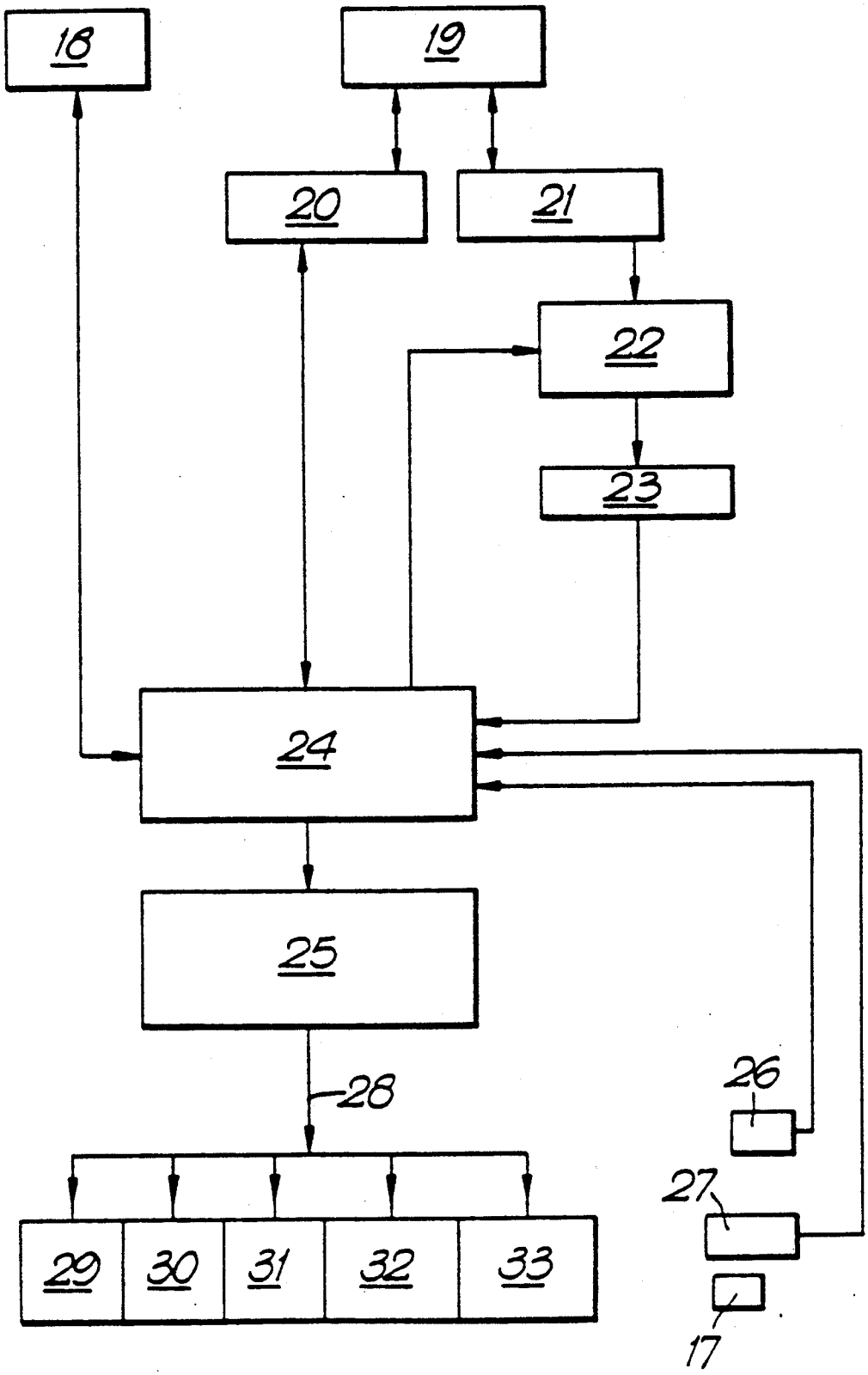
FIG. 5 is a block diagram of the control system.

FIG. 5 illustrates by means of a block diagram one possible means of processing pulses from a radiation detector in order to derive a data output signal that can be employed for jig control. It is to be understood that the electronics module illustrated may contain a number of micro-processors or programmable integrated circuit devices. In such a circumstance, the functions of particular blocks may be integrated into one device or group of devices or may be separated into different physical units as may be convenient to the particular features of the devices used to implement the functions required. The description of the function of the various blocks is undertaken without limiting the scope of the invention to a particular physical separation of the functions required. The scintillation-type detector 19 or other type of so-called proportional counter, which measures the radiation from a source 18, is powered from a detector stabilisation module 20 in such a way as to maintain the operation characteristics and, particularly, the gain of the detector constant; the stabilisation may also include temperature regulation of the detector. Output pulses from the detector are passed to pulse shaping and discrimination circuitry 21 where pulse pile-up detection and pulse height analysis may be carried out. The discrimination circuitry 21 must also contain dead-time correction circuits or circuits for the accurate determination of the detector live-time. The output pulse train from the unit 21 is passed to pulse counting and timing circuitry 22 wherein the gating of the pulse train according to timing pulses accurately delineating the consecutive short time segments of the jig cycle for which dead-time-corrected count rates are to be determined. It may also be necessary to pass the live or dead-time information from the unit 21 to the unit 22. The time segment delineation circuitry also receives control information from the control and computation unit 24 for the purpose, for example, of defining the actual duration of the short time segments. The circuitry 22 should operate in such a way as to transfer a value or values to the registers 23 representing either the dead-time-corrected count rate for a short time segment or the counts and live time for a short time period. The circuitry should operate in such a way that all pulses from the circuitry 21 are accounted for. The overall objective of the units 19 to 23 is to make available, at the end of each short time segment of the jig cycle, defined by the unit 24, a stable dead-time-corrected count rate in a register that may be read by a control and computation unit 24. The exact means of detector stabilisation is not considered here but should employ current art.

The control and computation unit 24 is in communication with all elements of the system 18 to 23 and with a user interface or host computer 25. In addition, it may monitor jig status signals 27 and receive a jig cycle synchronisation signal 26 which precisely indicates the beginning of a jig cycle. The unit 24 monitors the state of jig operation and the integrity of the source and detector shrouds as well as ensuring that the gating of the count rate information from the detector corresponds exactly to the chosen pattern. For example, for a jig cycle of 1000 milliseconds and a division of the jig cycle into 20 consecutive short time intervals, each gating signal must be issued at 50 millisecond intervals. Furthermore, if the timebase for the jig cycle is not derived from the same clock oscillator as that for the unit 24, then the unit 24 must continually monitor and compensate for differences in the timebases to eliminate as far as possible errors in count rate which will result from a failure of the unit 24 to divide the time interval between consecutive jig synchronisation pulses 26 into an integral number of equal time intervals. This latter function is particularly important when signal averaging over a substantial number of consecutive jig cycles is being undertaken. Differences in the timebases can result from temperature changes in electronics modules for example. The unit 24 is also programmed to carry out signal averaging wherein count rates from corresponding short time intervals from consecutive jig cycles are arithmetically averaged or averaged according to a weighted averaging algorithm. The number of consecutive cycles to be averaged and the manner in which the average is to be weighted can be communicated to the unit 24 from the interface or computer 25. The control and computation unit produces the jig signature at the end of each jig cycle or after a predetermined number of jig cycles have taken place.

The control action which is responsible for maintaining the separation specific gravity of the jig at the desired value is carried out by making changes in the data output 28. The data output can be defined as a set of digital or analog electrical signals which are applied to final control elements for the jig operating settings such a jig cycle times (inlet and exhaust valve opening and closing times 29, 30), underbed water flow rate 31, discharge gate positions 32, jig working air pressure 33 and such other parameters as may be available for automatic manipulation. The extent to which any data output value is varied when a new measure of the jig signature becomes available is determined by an algorithm executed in either the unit 24 or 25 as may be convenient. This algorithm makes a comparison between a "set point" or standard jig signature stored in unit 24 or 25 and the new signature just determined. If the new signature is statistically different from the standard signature and the difference is greater than a predetermined amount at any point within the jig period, one or more of the data output signals 29–33 are recalculated so as to restore the jig signature to a form more nearly matching the standard signature.

Figure 6:
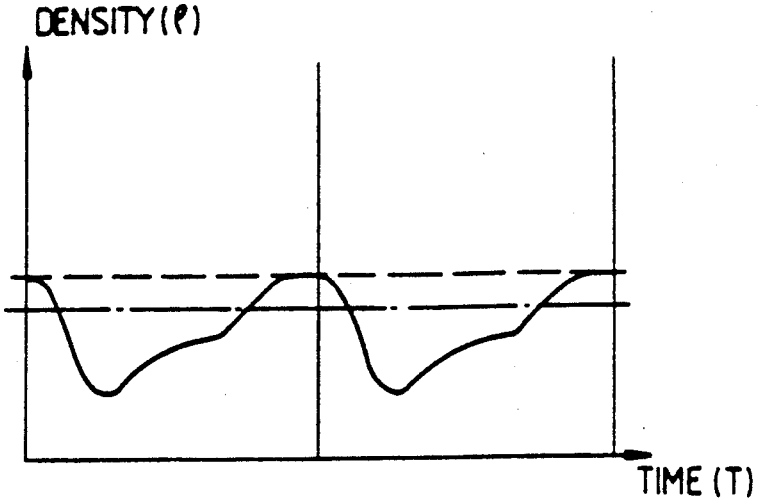
FIG. 6 is a graph of the variation in bed density over two cycles.
Figure 7:
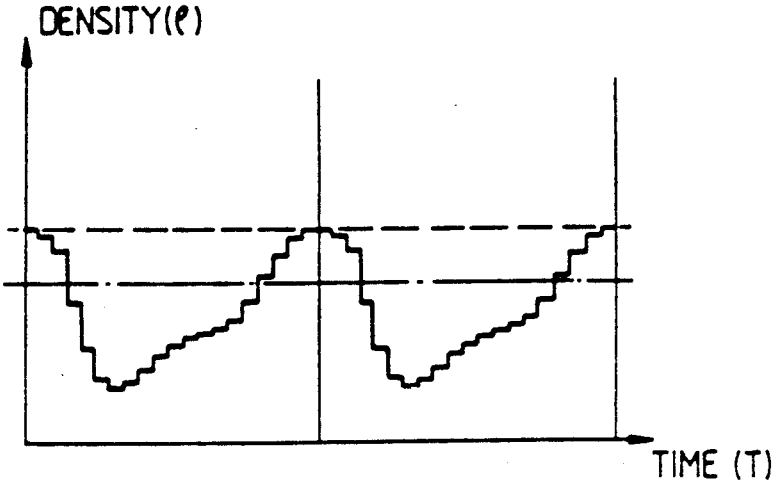
FIG. 7 is a graph of the discretisation of the actual density via the nucleonic measurement.
Figure 8:
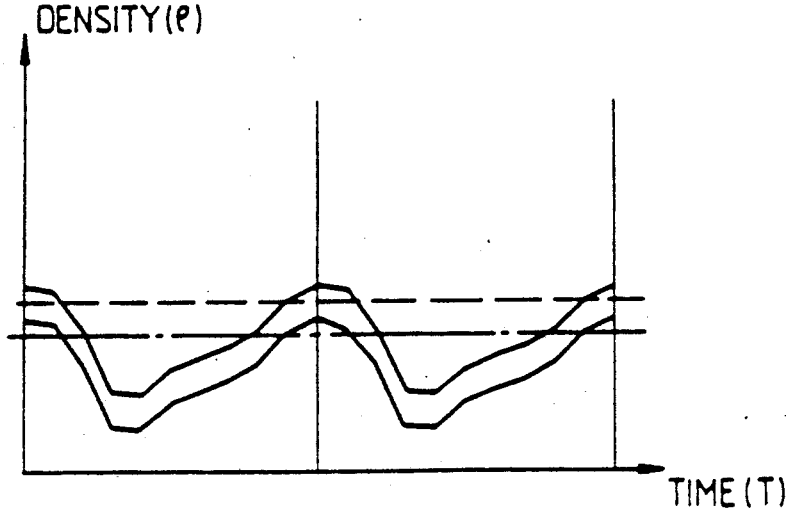
FIG. 8 is a graph of a control envelope about the standard jig signature.

The concept of the jig signature is illustrated in FIGS. 6 to 8. The terms "signature" and "profile" may be used interchangeably.

A jig cycle is based on the periodic pulsation of the fluid in the jig. For example, as shown in FIG. 6, the jig cycle begins with the jig bed in a settled condition. As fluid is introduced into the bed, the density decreases to a minimum. As the fluid exits, the density increases, the bed settles, and the cycle is complete when the density reaches its maximum value again. FIG. 6 shows two consecutive jig cycles. The time from maximum density to minimum density and back to maximum density is one jig cycle. In FIG. 6, the graph represents schematically the actual variation in the bed density ($\rho$) that occurs starting from the state of the compacted bed, two consecutive jig cycles being shown. In FIG. 7, the graph illustrates the discretisation of the actual density variation via the nucleonic measurement; the jig cycle has been divided into 20 equal time intervals (the time intervals into which the cycle is divided need not be equal but it is generally convenient to make them so). In FIG. 8, the graph illustrates a control envelope about some standard jig signature. The preselected control envelope represents the deviation allowable from the standard jig signature for which no changes in the data output values 29–33 are required. The area within the control envelope, therefore, represents the allowable variation in the jig signature. If any part of a new jig signature is located outside the control envelope, then adjustment of one or more of the output values 29–33 is necessary in order to return the jig signature to the area within the control envelope. The control concept according to this invention corresponds to the determination of a new set of data output values whenever a new jig signature does not lie entirely within the control envelope. The manner in which the data output values 29–33 are changed depends upon the region or regions of the envelope where the mismatch or mismatches occur so as to return the jig signature to within the control envelope.

As will be readily apparent to the skilled addressee, the present invention enables the jig separator to be most efficiently operated. As discussed above, the profile of the variation in density of the bed is critical to the operation of the jig. To simply take a single time segment in a cycle and measure the bed density e.g. as in German Patent No. 1,245,281 is not sufficient for separator control. An infinite number of jig signatures can have a common profile over a selected time segment in a cycle, yet the stratification levels achieved in the separator can be markedly different. For example, a signature which has a portion with a very sharp change in density compared with the most preferred jig signature will result in less efficient stratification. In addition, the operation of the jig separator can be accurately tailored to suit the particular mineral to be separated.

The embodiments described are by way of illustrative examples only and various changes and modifications may be made thereto without departing from the scope of the present invention defined in the appended claims.

I claim:

1. A method for the control of jig separators for minerals including the steps of:

measuring the density of the material in the jig bed in consecutive short segments of a jig cycle;

determining a density signature or profile of the jig bed over the jig cycle;

selecting a control envelope;

comparing the density signature to the preselected control envelope; and adjusting the operating parameters of the jig to maintain the density signature or profile within the preselected control envelope.

2. A method according to claim 1 wherein:

the measuring of the density is accomplished by providing at least one radiation detector.

3. A method according to claim 1 wherein:

the time period of each segment of the jig cycle is not greater than one-tenth of the cycle time of the separator.

4. A method according to any one of claims 1 to 3 wherein:

count rate information from the detector is processed by taking the logarithms of the count rates from the consecutive time segments, where the logarithms of the count rates are related linearly to the density of the material in the bed.

5. A method according to claim 4 wherein:

the processing of the count rate information includes a signal averaging step by calculation of an arithmetic average or weighted average of the count rates or logarithms of the count rates of consecutive cycles of the jig operation.

6. A method according to claim 5 wherein:

the optimal number of consecutive cycles over which the average is calculated is dependent on the count rates at the detector.

7. A method according to claim 1 wherein:

the operating parameters which are adjustable include at least one of the following: the inlet valve open and closing times, the exhaust valve opening and closing times, the underbed flow rate, the discharge gate position, and the jig working air pressure.

8. A method according to claim 1 wherein:

the control envelope for the jig separator for a particular mineral is determined empirically and is then set in a control and computation unit which controls the operating parameters of the jig.

9. Apparatus for the control of jig separators for mineral including:

a radiation source;

at least one radiation detector in a jig bed to measure the absorption of the radiation from the source by the material in the jig bed;

timing means to separate a jig cycle into consecutive short segments;

computation means to determine the actual density of the material in the bed in each segment from the count rate by the detector and thereby determine a density signature or profile over the jig cycle;

a preselected control envelope;

comparison means for comparing the density signature with the control envelope; and control means operating in response to the density profile signature or profile to vary the operating parameters of the jig to maintain the density signature or profile within the preselected control envelope.

* * * * *